United States Patent [19]

Lorenz et al.

[11] Patent Number: 4,539,450

[45] Date of Patent: Sep. 3, 1985

[54] DISCONNECT SWITCH

[75] Inventors: Dieter Lorenz; Benno Rehaag, both of Berlin, Fed. Rep. of Germany

[73] Assignee: Siemens Aktiengesellschaft, Munich, Fed. Rep. of Germany

[21] Appl. No.: 394,163

[22] Filed: Jul. 1, 1982

[30] Foreign Application Priority Data

Jul. 10, 1981 [DE] Fed. Rep. of Germany ..... 3127960

[51] Int. Cl.[3] ..... H01H 33/42

[52] U.S. Cl. ..... 200/148 F; 200/146 R; 200/148 R

[58] Field of Search ..... 200/148 F, 146 R, 148 A, 200/148 B, 144 R

[56] References Cited

U.S. PATENT DOCUMENTS 1,706,746 3/1929 Rice ..... 200/148 F
3,943,314 3/1976 Frink ..... 200/148 B

OTHER PUBLICATIONS

Siemens Operating Instruction SW 8378-220 "Load Disconnect Switch 3CB, 10 kV", pp. 102/1 to 102/3.

*Primary Examiner*—Robert S. Macon
*Attorney, Agent, or Firm*—Kenyon & Kenyon

[57] ABSTRACT

A disconnect switch has a fixed tubular contact, an associated fixed auxiliary contact connected thereto, and a movable tubular contact which is guided in a stationary outer housing. The movable tubular contact contains a movable auxiliary contact. Both movable contacts are separately movable into connection with the fixed contacts. To enable the switch to be used for higher voltages while achieving short pre-breakdown times and using a drive which operates at normal speed, the movable auxiliary contact is at first latched against movement, compressing a spring. The movable auxiliary contact is then released to actuate the switch. To this end, each end of the movable auxiliary contact is provided with a catch which can be engaged by a cooperating pawl located at either end of the travel of the auxiliary contact. A control member is longitudinally movable on the movable auxiliary contact. A spring is mounted between the control member and each of the catches. The control member is coupled to the movable tubular contact via a reduction drive.

3 Claims, 10 Drawing Figures

T 1
27
9
20
8
7
23
28
11
29
30
14

DISCONNECT SWITCH

BACKGROUND OF THE INVENTION

This invention relates to a disconnect switch for metal-encapsulated switching installations. Such switches have a fixed tubular contact engaged by a movable contact tube which is guided in a stationary outer part. Inside of the movable contact tube there is an auxiliary contact which is movable relative thereto, which is acted upon by a spring, and which connects to a fixed auxiliary contact forming part of the stationary contact.

A disconnect switch of this type, described in Siemens Operating Instructions SW 8378-220 "Load Disconnect Switch 3CB, 10 kV," pages 102/1 to 102/3, is designed as a load disconnect switch (circuit breaker) and has an auxiliary contact pin which, during the switching-off movement, permits formation of an arc only between a so-called sliding contact and a burn-off ring of the movable contact because this arc frees gas from the insulating material of the stationary outer part; the gas escapes from the quenching cup in a strong flow, deionizing the switching gap. Since a quenching device is not provided between the fixed contact and the moving contact in this load disconnect switch, a metallic connection must be maintained between these two contact elements during switching off via an auxiliary contact, until the switching path is interrupted after the arc is extinguished. The auxiliary contact is then pulled out of contact with the auxiliary part of the fixed contact so that the disconnect switch is visibly separated.

It is an object of the present invention to provide a disconnect switch of the above type which can be used at higher voltages and which has short pre-breakdown times with the large switching gaps required in such structures, without necessitating a particularly fast-operating drive. Pre-breakdown time is to be understood here to mean that time during which an arc occurs between the fixed contact and the movable contact in the switch opening process.

SUMMARY OF THE INVENTION

According to the invention this problem is solved, in a disconnect switch of the type described at the outset, by providing a pawl on the end of the movable contact tube nearest to the fixed contact to cooperate with a catch on the forward end of the movable auxiliary contact. Another pawl is mounted on the stationary outer part and cooperates with a catch carried on the rear end of the movable auxiliary contact. A control member which is movable in the longitudinal direction is arranged in the movable contact tube. One spring each is disposed on the movable auxiliary contact between the control member and each of the two catches. The control member is connected to the movable contact tube via a reduction drive, and is guided so that the pawl can be actuated by its movement.

It is an essential advantage of the disconnect switch of the invention that, during the closing movement, the movable auxiliary contact comes into connection with the fixed auxiliary contact considerably faster than the movable contact tube connects with the stationary contact, resulting in a considerable shortening of the pre-breakdown time during the closing process. The same applies to the opening process, because contact between the movable auxiliary contact and the fixed auxiliary contact is maintained for a certain time after the separation and only then is the movable auxiliary contact released suddenly from the fixed auxiliary contact under the influence of the respective spring. A further advantage lies in the fact that the shortening of the pre-breakdown times is achieved with a relatively slow, conventional, drive; the inexpensive slow drive can thus be retained.

In the disconnect switch of the invention, the reduction drive can be designed in different ways and may consist, for instance, of a gear drive. For design reasons and to keep production costs as low as possible, however, it is more advantageous for the reduction drive to be a cable drive. In the illustrative embodiment, this drive comprises two guide pulleys which are supported in bearings spaced apart in the movable contact by a predetermined axial distance. One end of a cable is fastened to a point of the stationary outer part which lies in the vicinity of the rear end of the auxiliary contact pin. From there, the cable is first brought around the guide pulley which is farthest away and then around the other, nearer, guide pulley. The other end of the cable is attached at a point on the stationary outer part which lies between the guide pulleys and is close to the first guide pulley when the disconnect switch is in the opened condition. The control member is connected to the part of the cable which lies between the guide pulleys when the disconnect switch is in the opened condition. The use of this relatively simple drive results in movement of the control member faster than the contact pin and in compression of the respective spring, so that the movable auxiliary contact, when the pawl holding it at its forward end by means of the extension is released, can spring forward to cause accelerated contact with the auxiliary contact.

The control member of the disconnect switch according to the invention may also be designed in different ways. It is particularly advantageous when the control element consists of a disc-like part which slides on the movable auxiliary contact which is coupled at right angles to an actuator for the pawls.

DETAILED DESCRIPTION OF THE INVENTION

Figures 1, 2, 3, 4, 5:
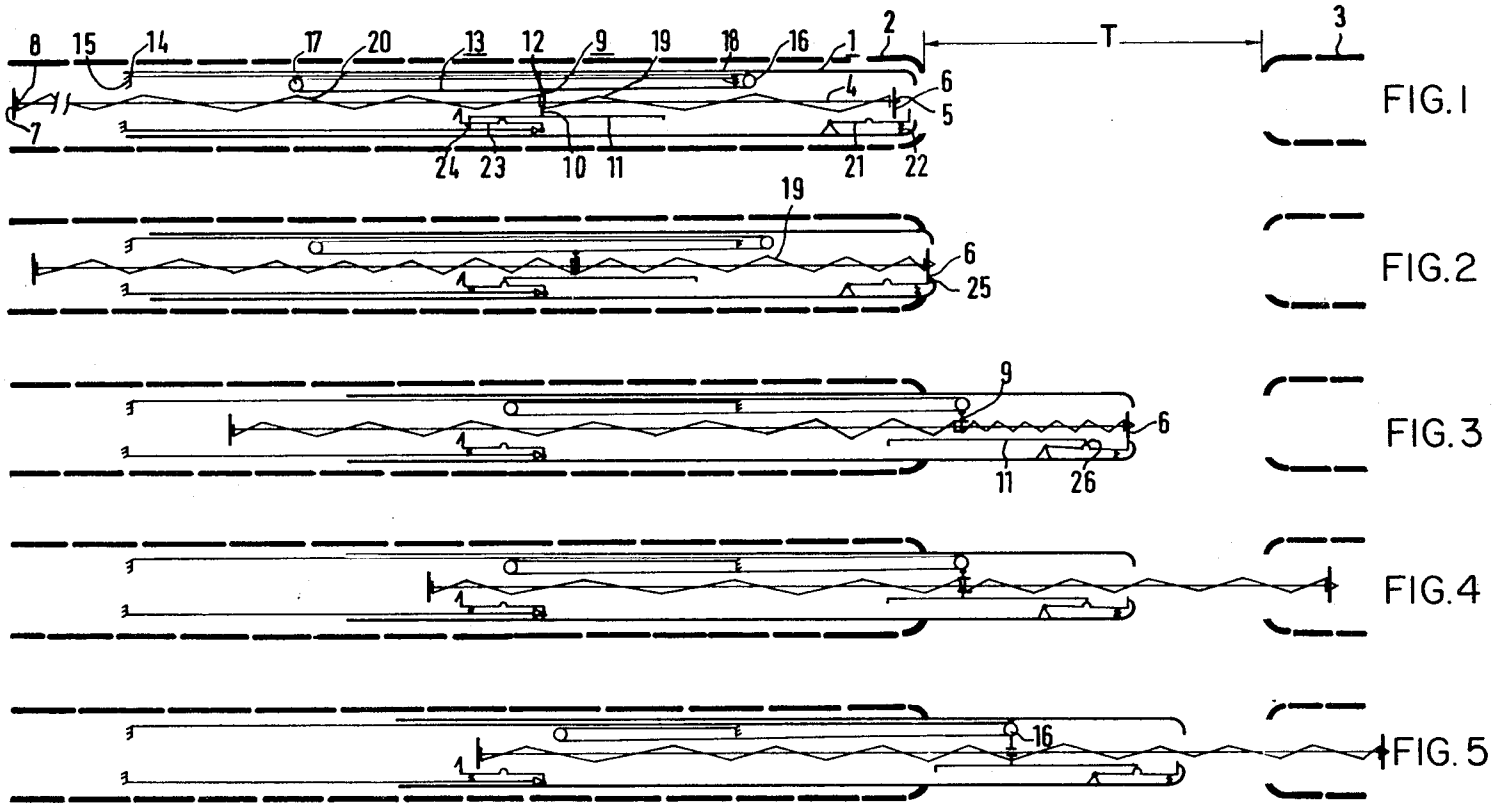
FIGS. 1–6 are schematic diagrams, taken from the side, of a circuit breaker disconnect switch according to the invention, showing the switch in positions progressing from open to closed.

As FIG. 1 shows, the illustrated embodiment has main contact tube 1 which is held, movable in the lengthwise direction, in stationary tubular outer part 2. Movable contact tube 1 is arranged opposite fixed contact 3 with which it mates, the distance between stationary outer part 2 and fixed contact 3 being designated as switching gap T.

Movable auxiliary contact 4 is disposed inside main contact 1 and can travel in a lengthwise direction therein. At its forward end 5, e.g. the end nearest to fixed contact 3, movable auxiliary contact 4 is provided with lateral catch 6. Movable auxiliary contact 4 also has a similar catch 7 at its rear end 8. Control member 9 is arranged slidably on movable auxiliary contact 4 and has disc-like part 10 to which actuator 11, extending at right angles thereto, is fastened.

As seen in FIG. 1, control member 9 is fastened, at its upper end, to section 12 of cable 13. One end 14 of cable 13 is attached to fastening point 15 which is located on stationary tubular housing part 2. Starting from fastening point 15, the cable is brought along, inside of movable contact tube 1, over and past guide pulley 16 which is attached to movable contact 1 near the forward end thereof. From this, first, guide pulley 16, cable 13 is directed back from the forward end of movable contact 1 and brought around second guide pulley 17. Pulley 17 is supported from the rear on movable contact tube 1 at a predetermined axial distance from first guide pulley 16. The cable then runs forward from second guide pulley 17 to fastening point 18 which is located, like fastening point 15, on stationary outer part 2. When the disconnect switch is open, fastening point 18 lies near first guide pulley 16 and in the region between the two guide pulleys.

First and second springs 19 and 20, respectively, are located on movable auxiliary contact 4 between disc-shaped part 10 of control member 9 and catches 6 and 7, respectively, of movable auxiliary contact 4.

First pawl 21, linked to movable contact 1, is urged by its associated compression spring 22 towards movable auxiliary contact 4. Second pawl 23 is linked to stationary tubular outer part 2 and is pushed by an associated compression spring 24 in the direction of auxiliary contact pin 4. Both pawls 21 and 23 are arranged so that they are located in the operating range of actuator 11 of control member 9.

To explain the illustrated embodiment of the disconnect switch of the invention in further detail, reference is now made to the succeeding figures in which the disconnect switch is shown in its different states.

FIG. 2 shows that movable contact tube 1, due to external actuation, not shown, has moved a short distance to the right in the direction of fixed contact 3; control member 9 has been moved so far to the right by cable 13 that, due to the resultant compressive tensioning of spring 19, catch 6 of movable auxiliary contact 4 has been pushed against stop 25 on pawl 21. In the course of further actuation of movable contact 1, spring 19 is compressed more and more because, due to the cable drive, the control member travels relatively twice as far as movable contact 1. Control member 9 eventually gets into the position shown in FIG. 3, with pawl 21 depressed by hook 26 of actuator 11. Catch 6 of movable auxiliary contact 4 is thereby released and movable auxiliary contact 4 springs forward into the position shown in FIG. 4. Here, a metallic connection is established between movable auxiliary contact 4 and a fixed auxiliary contact, not shown, in fixed contact 3. Movable contact tube 1, movable auxiliary contact 4 and fixed contact 3 are now all at the same potential.

Figures 6, 7, 8, 9, 10:
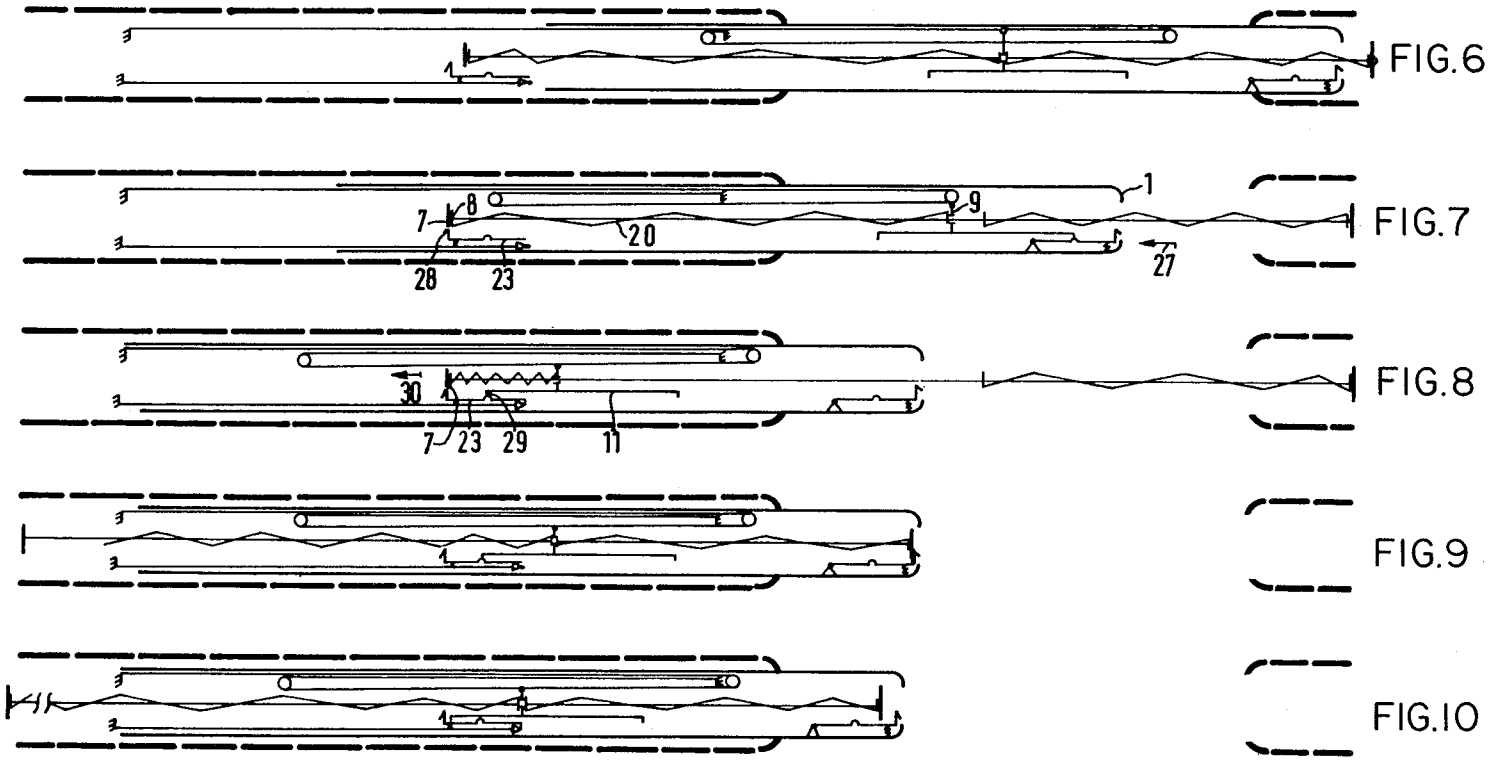
FIGS. 7–10 are similar schematic diagrams which show the switch in positions as it is configured after opening has begun and continuing to the fully open position.

When movable contact 1 is urged still further toward fixed contact 3, the fastening point of disc-shaped part 10 of control member 9 travels around guide pulley 16, reversing its direction of travel, and assumes the position shown in FIG. 5. In this way, the movable auxiliary contact is inserted still further into the fixed auxiliary contact. As movable contact 1 advances still further, control member 9 now no longer moves forward but remains in the position shown in FIG. 5, while movable contact 1 continues its motion and comes into engagement with stationary contact 3. The closing motion is finished; the disconnect switch is closed. This is shown in FIG. 6.

When the disconnect switch is opened (FIG. 7), movable contact 1 is moved in the direction of arrow 27 control element 9 reverses its course and travels back around pulley 16 into the position shown. Here, catch 7 on rear end 8 of movable auxiliary contact 4 is brought against stop 28 of second pawl 23. Spring 20 begins to be compressed during the further backward movement of contact 1 and the accompanying movement of control element 9. When control member 9 reaches the position shown in FIG. 8, due to the motion of movable contact 1, second pawl 23 is depressed by hook 29 of actuator 11 and catch 7 of movable auxiliary contact 4 is released. Auxiliary contact 4 therefore springs back in the direction of arrow 30 and the metallic connection between its foward end and the fixed auxiliary contact (not shown) is severed, as shown in FIG. 9. When, as shown in FIG. 10, movable contact 1 is returned to its starting position, the control element also resumes its original position and the forward end of movable auxiliary contact 4 is again inside contact pin 1.

Thus, in the disconnect switch of the invention, it is possible, with a small, relatively compact structure, to drive the control member to a given position twice as fast as the movable main contact, putting the spring attached to the movable auxiliary contact under the pretension of a spring. Then, when the movable auxiliary contact is released, it makes contact with the fixed auxiliary contact suddenly, long before the movable main contact has made contact with the stationary main contact. In this way, a short pre-breakdown time during the closing process is obtained.

During opening, the motion of the control element relative to the contact pin is first delayed while a second spring is pretensioned. Interruption of contact between the movable auxiliary contact and the fixed auxiliary contact is then achieved, after this spring is released, at an instant when the movable main contact has moved very far from the stationary contact.

What is claimed is:

1. A disconnect switch comprising:

a fixed tubular contact coupled to a fixed auxiliary contact;

a movable contact tube guided in a stationary outer part, the movable contact tube spaced apart from the fixed tubular contact and comprising a forward end, adapted to connect with the fixed tubular contact, and a rear end;

a movable auxiliary contact disposed within the movable contact tube and comprising a forward end, adapted to connect with the fixed auxiliary contact, and a rear end;

a first catch at the forward end of the movable auxiliary contact;

a first pawl at the forward end of the movable tubular member, the first pawl cooperating with the first catch;

a second catch at the rear end of the movable auxiliary contact;

a second pawl supported on the stationary outer part, the second pawl cooperating with the second catch;

a control member disposed in the movable tubular contact tube and movable longitudinally therein to release either one of the pawls;

a first spring between the control member and the first latch;

a second spring between the control member and the second latch; and a reduction drive coupling the control member to the movable tubular contact.

2. A disconnect switch in accordance with claim 1 in which the reduction drive comprises a cable drive, the cable drive comprising:

first and second guide pulleys supported in bearings on the movable tubular contact at a predetermined axial distance from each other; and a cable, one end of the cable fastened to a first point of the stationary outer part near the rear thereof, the cable brought forward and around the guide pulley which is farthest from the first point, the cable then brought rearward and around the pulley which is nearest to the first point, the other end of the cable fastened to a second point on the stationary housing part, the second point lying between the guide pulleys and adjacent to the first guide pulley when the switch is in the open condition, and in which:

the control member is connected to that portion of the cable which lies between the pulleys when the switch is in the open condition.

3. A disconnect switch in accordance with claim 1 in which the control member comprises a disc-like part slidably mounted on the movable auxiliary contact and an actuating part attached at right angles to the disc-like part for releasing the pawls.

* * * * *